US009129571B2

(12) United States Patent
Chien et al.

(10) Patent No.: US 9,129,571 B2
(45) Date of Patent: Sep. 8, 2015

(54) PARTIALLY-DRIVEN DISPLAY APPARATUS

(71) Applicant: AU OPTRONICS CORP., Hsin-Chu (TW)

(72) Inventors: Kuo-Hsiang Chien, Hsin-Chu (TW); Kai-Yuan Siao, Hsin-Chu (TW); Chun-Hsien Lin, Hsin-Chu (TW); Tien-Chin Huang, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 243 days.

(21) Appl. No.: 13/747,562

(22) Filed: Jan. 23, 2013

(65) Prior Publication Data

US 2013/0314310 A1 Nov. 28, 2013

(30) Foreign Application Priority Data

May 22, 2012 (TW) ..... 101118254 A

(51) Int. Cl.
*G09G 3/36* (2006.01)

(52) U.S. Cl.
CPC ..... *G09G 3/3611* (2013.01); *G09G 2310/021* (2013.01); *G09G 2310/0218* (2013.01); *G09G 2310/0286* (2013.01)

(58) Field of Classification Search
USPC ..... 345/99, 100, 103
See application file for complete search history.

(56) References Cited

U.S. PATENT DOCUMENTS

| | | | | |
|---|---|---|---|---|
| 7,123,247 | B2 | 10/2006 | Morita | |
| 7,924,258 | B2 * | 4/2011 | O et al. | 345/100 |
| 8,427,413 | B2 * | 4/2013 | Kitayama et al. | 345/94 |
| 2005/0168491 | A1 * | 8/2005 | Takahara et al. | 345/690 |
| 2006/0221050 | A1 | 10/2006 | Sakamoto et al. | |
| 2008/0117159 | A1 | 5/2008 | Cheng | |
| 2009/0066622 | A1 * | 3/2009 | Yang et al. | 345/89 |
| 2010/0277463 | A1 * | 11/2010 | Yen et al. | 345/213 |
| 2010/0315402 | A1 | 12/2010 | Hashimoto et al. | |
| 2011/0102389 | A1 * | 5/2011 | Park et al. | 345/205 |
| 2011/0267333 | A1 | 11/2011 | Sakamoto et al. | |

FOREIGN PATENT DOCUMENTS

| | | |
|---|---|---|
| CN | 101923839 A | 12/2010 |
| CN | 102338958 A | 2/2012 |
| TW | 200823830 | 6/2008 |
| TW | I327716 | 7/2010 |
| TW | 201039310 | 11/2010 |

OTHER PUBLICATIONS

Taiwan Patent Office, "Office Action", May 20, 2014.
China Patent Office, "Office Action", May 30, 2014.

* cited by examiner

*Primary Examiner* — Kwang-Su Yang
(74) *Attorney, Agent, or Firm* — WPAT, P.C.; Justin King

(57) ABSTRACT

A display apparatus and an operation method thereof are provided. The display apparatus includes a display panel. The display panel includes a plurality of data lines, a plurality of scan lines and a plurality of pixels. The pixels are arranged in a matrix manner, and each pixel is electrically connected to one of the data lines and one of the scan lines. The operation method includes steps of: dividing the scan lines into N scan line groups, wherein N is an integer from 2 to the number of the scan lines; and in N frame periods sequentially driving the N scan line groups of scan line respectively and thereby sequentially updating display data of the pixels electrically connected to the N scan line groups of the scan line respectively.

10 Claims, 8 Drawing Sheets

PARTIALLY-DRIVEN DISPLAY APPARATUS

TECHNICAL FIELD

The disclosure relates to a display technical field, and more particularly to a display apparatus and an operation method thereof.

BACKGROUND

Conventionally, a display apparatus is operated by driving the scan lines thereof one after one. However, the display apparatus may consume more electrical power in this operation manner.

SUMMARY OF EMBODIMENTS

An embodiment of the present disclosure provides a display apparatus, which includes a display panel, a data driving circuit, a scan driving circuit and a timing control circuit. The display panel includes a plurality of data lines, a plurality of scan lines and a plurality of pixels. The pixels are arranged in a matrix manner, and each pixel is electrically connected to one of the data lines and one of the scan lines. The data driving circuit is electrically connected to the data lines. The scan driving circuit is electrically connected to the scan lines. The timing controller is electrically connected to the scan driving circuit and the data driving circuit and configured to divide the scan lines into N scan line groups, sequentially drive, through the scan driving circuit, the N scan line groups of scan line in N frame periods respectively and thereby sequentially updating display data of the pixels electrically connected to the N scan line groups of the scan line in the N frame periods respectively; wherein N is an integer from 2 to the number of the scan lines.

Another embodiment of the present disclosure provides an operation method of a display apparatus. The display apparatus includes a display panel. The display panel includes a plurality of data lines, a plurality of scan lines and a plurality of pixels. The pixels are arranged in a matrix manner, and each pixel is electrically connected to one of the data lines and one of the scan lines. The operation method includes steps of: dividing the scan lines into N scan line groups, wherein N is an integer from 2 to the number of the scan lines; and in N frame periods sequentially driving the N scan line groups of scan line respectively and thereby sequentially updating display data of the pixels electrically connected to the N scan line groups of the scan line respectively.

Still another embodiment of the present disclosure provides a display apparatus, which includes a display panel, a data driving circuit, a scan driving circuit and a timing control circuit. The display panel includes a plurality of data lines, a plurality of scan lines and a plurality of pixels. The pixels are arranged in a matrix manner, and each pixel is electrically connected to one of the data lines and one of the scan lines. The data driving circuit is electrically connected to the data lines and configured to provide display data to the pixels through the data lines. The scan driving circuit is electrically connected to the scan lines and includes a shift register and a plurality AND gates. The shift register includes a plurality of stages of shift register unit and configured to control the shift register units to sequentially provide a scan pulse through an output terminal thereof. The AND gates each have a first input terminal, a second input terminal and an output terminal. The AND gate is configured to have its first input terminal electrically connected to the output terminal of one of the shift register units, its second input terminal for receiving a first output control signal and its output terminal electrically connected to one of the scan lines. The timing controller is electrically connected to the data driving circuit and the scan driving circuit and configured to control the data driving circuit to provide the display data of the pixels and output the first output control signal to the scan driving circuit thereby controlling an operation of the scan driving circuit through the first output control signal. The first output control signal has a plurality of pulses, and each pulse is used to control the scan driving circuit to output a scan pulse for driving one of the scan lines.

BRIEF DESCRIPTION OF THE DRAWINGS

The above embodiments will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

One object of the present disclosure is to provide a display apparatus consuming less power.

Another object of the present disclosure is to provide an operation method for the aforementioned display apparatus.

Figure 1:
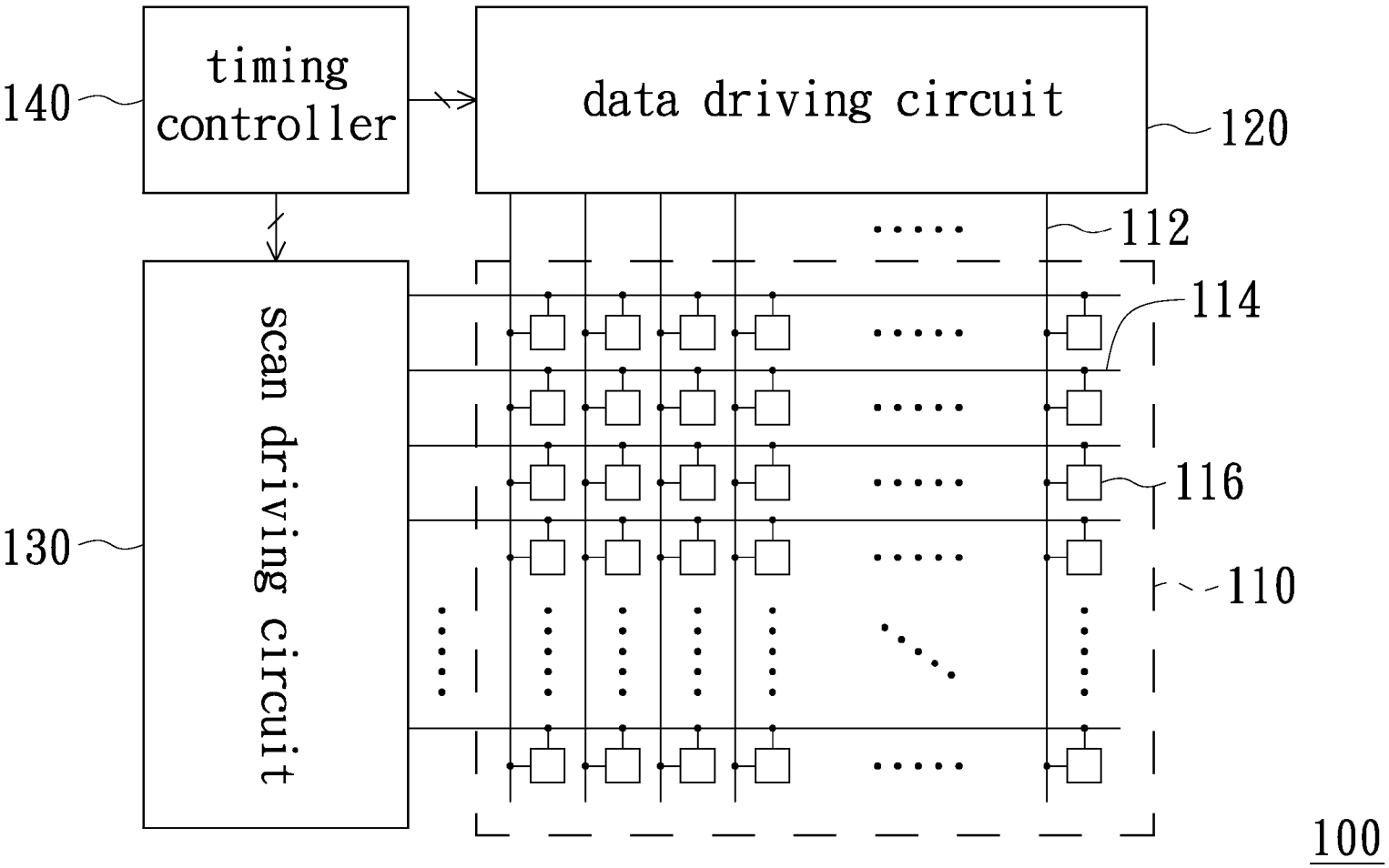
FIG. 1 is a schematic view of a display apparatus in accordance with an embodiment of the present disclosure.

FIG. 1 is a schematic view of a display apparatus in accordance with an embodiment of the present disclosure. As shown, the display apparatus 100 in this embodiment includes a display panel 110, a data driving circuit 120, a scan driving circuit 130 and a timing controller 140. The display panel 110 includes a plurality of data lines 112, scan lines 114 and pixels 116. Specifically, the pixels 116 are arranged in a matrix manner, and each is electrically connected to one data line 112 and one scan line 114; the data lines 112 are electrically connected to the data driving circuit 120; and the scan lines 114 are electrically connected to the scan driving circuit 130. The timing controller 140 is electrically connected to the scan driving circuit 130 and configured to control the scan driving circuit 130 to drive the scan lines 114. In addition, the timing controller 140 is further electrically connected to the data driving circuit 120 and configured to sequentially supply display data to the data driving circuit 120 and control the data driving circuit 120 to sequentially provide the display data to the pixels 116.

In this embodiment, the timing controller 140 is further configured to divide these scan lines 114 into N scan line groups and sequentially drive, through the scan driving circuit 130, the N scan line groups of scan line 114 in N frame periods, respectively; wherein N is an integer from 2 to the number of the scan lines 114. To get a better understanding of the present disclosure, the display panel 110 in this embodiment is exemplified by including eight scan lines 114 and the operation of the display apparatus 100 will be described in detail with the reference of FIGS. 2A, 2B.

Figure 2A:
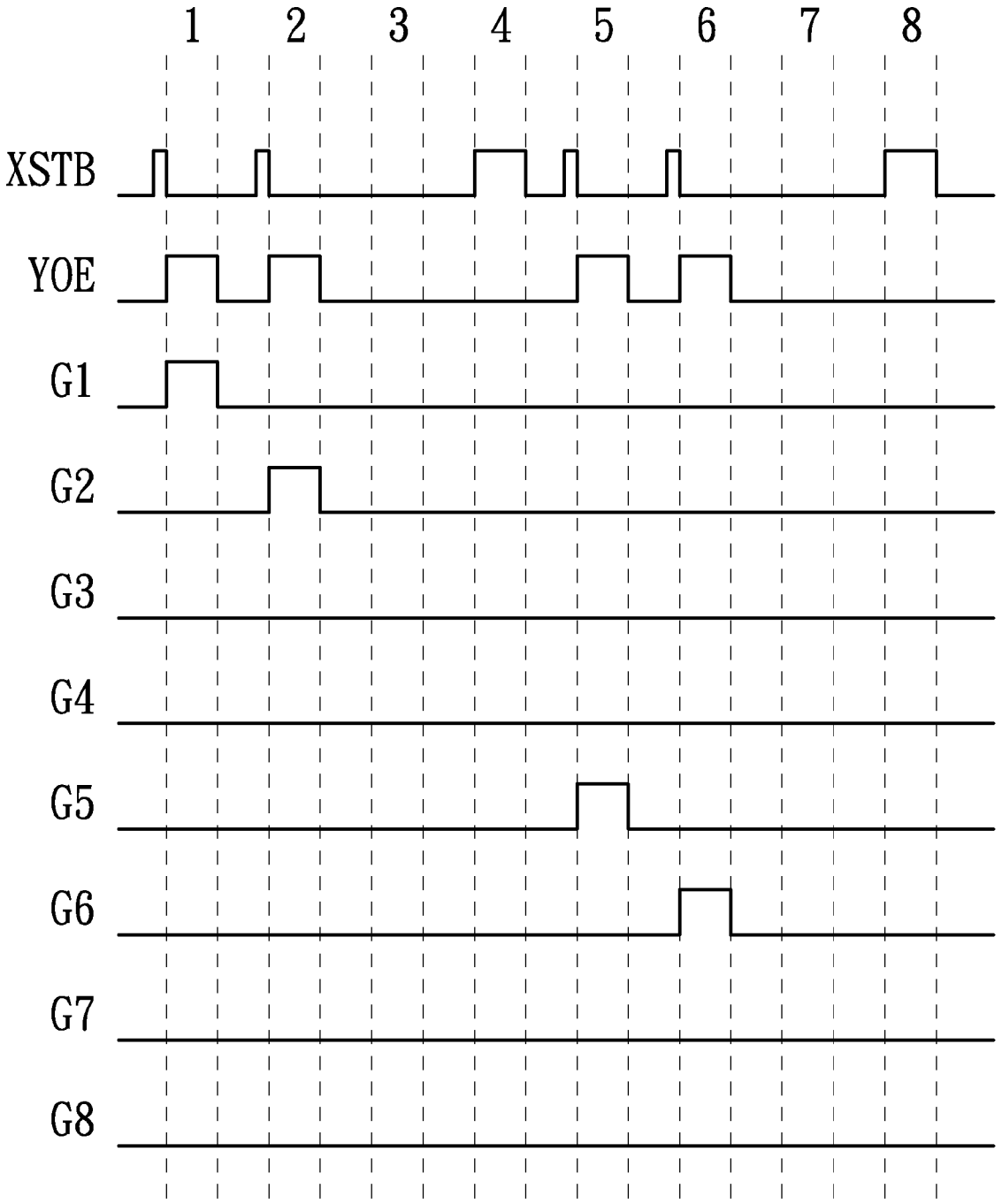
FIG. 2A is a schematic time sequence view of eight scan signals of the respective eight scan lines and other signals associated with the display apparatus in FIG. 1 in the $K_{th}$ frame period.
Figure 2B:
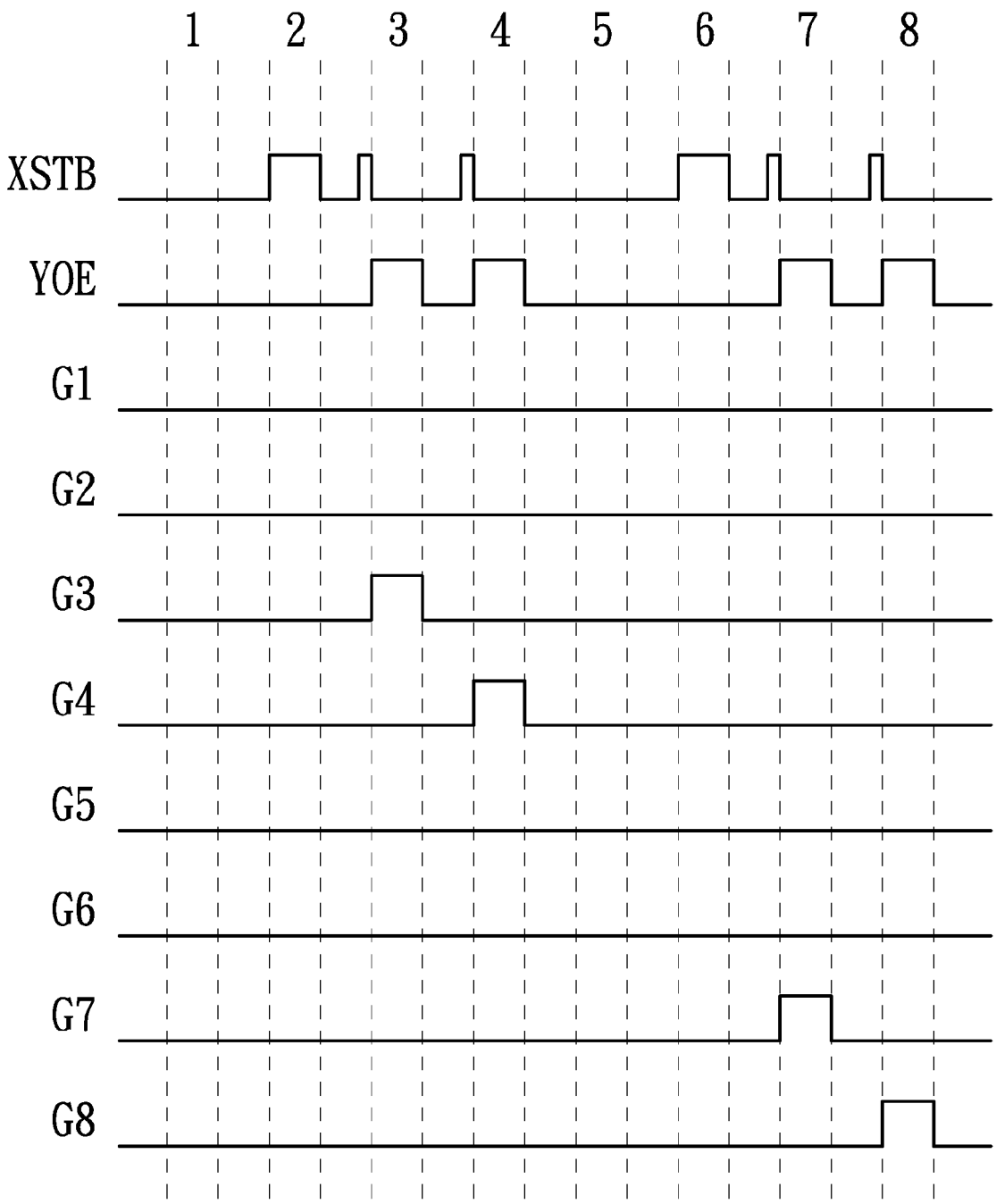
FIG. 2B is a schematic time sequence view of eight scan signals of the respective eight scan lines and other signals associated with the display apparatus in FIG. 1 in the $(K+1)_{th}$ frame period.

FIGS. 2A, 2B are schematic time sequence views of eight scan signals of the respective eight scan lines 114 and other signals associated with the display apparatus 100 in the $K_{th}$ and $(K+1)_{th}$ frame periods, respectively. Specifically, the eight scan signals of the respective eight scan lines 114 (from the first-row to the eighth-row scan lines 114) are designated by G1~G8, respectively. The signal XSTB, an output control signal and outputted from the timing controller 140 to the data driving circuit 120, is configured to control an operation of the data driving circuit 120. The signal YOE, an output control signal and outputted from the timing controller 140 to the scan driving circuit 130, is configured to control an operation of the scan driving circuit 130. The configurations of the output control signals XSTB, YOE for the operations of the respective data driving circuit 120 and the scan driving circuit 130 will be described in detail later.

In the $K_{th}$ frame period as illustrated in FIG. 2A, the scan signals G1, G2, G5 and G6 are exemplified by having one scan pulse at time periods 1, 2, 5 and 6, respectively; and the scan signals G3, G4, G7 and G8 each are exemplified by having no any scan pulse within the time periods 1~8. In the $(K+1)_{th}$ frame period as illustrated in FIG. 2B, the scan signals G3, G4, G7 and G8 are exemplified by having one scan pulse at time periods 3, 4, 7 and 8, respectively; and the scan signals G1, G2, G5 and G6 each are exemplified by having no any scan pulse within the time periods 1~8. Accordingly, the timing controller 140 can divide these eight scan lines 114 into two scan line groups; specifically, the first-row, the second-row, the fifth-row and the sixth-row scan lines 114 are defined to the first scan line group, and the third-row, the fourth-row, the seventh-row and the eighth-row scan lines 114 are defined to the second scan line group. Through the aforementioned division, in the $K_{th}$ frame period the timing controller 140 can drive, through the scan driving circuit 130, the first scan line group only and then drive the second scan line group in the $(K+1)_{th}$ frame period. In other words, the timing controller 140 can sequentially drive two scan line groups of scan line 114 so as to sequentially update the display data of the corresponding pixels 116 in two frame periods, respectively.

Therefore, through driving a portion of these scan lines 114 only (specifically, the scan lines 114 having a scan pulse) in a frame period, the display apparatus 100 according to the present disclosure can have lower power consumption.

Figure 3:
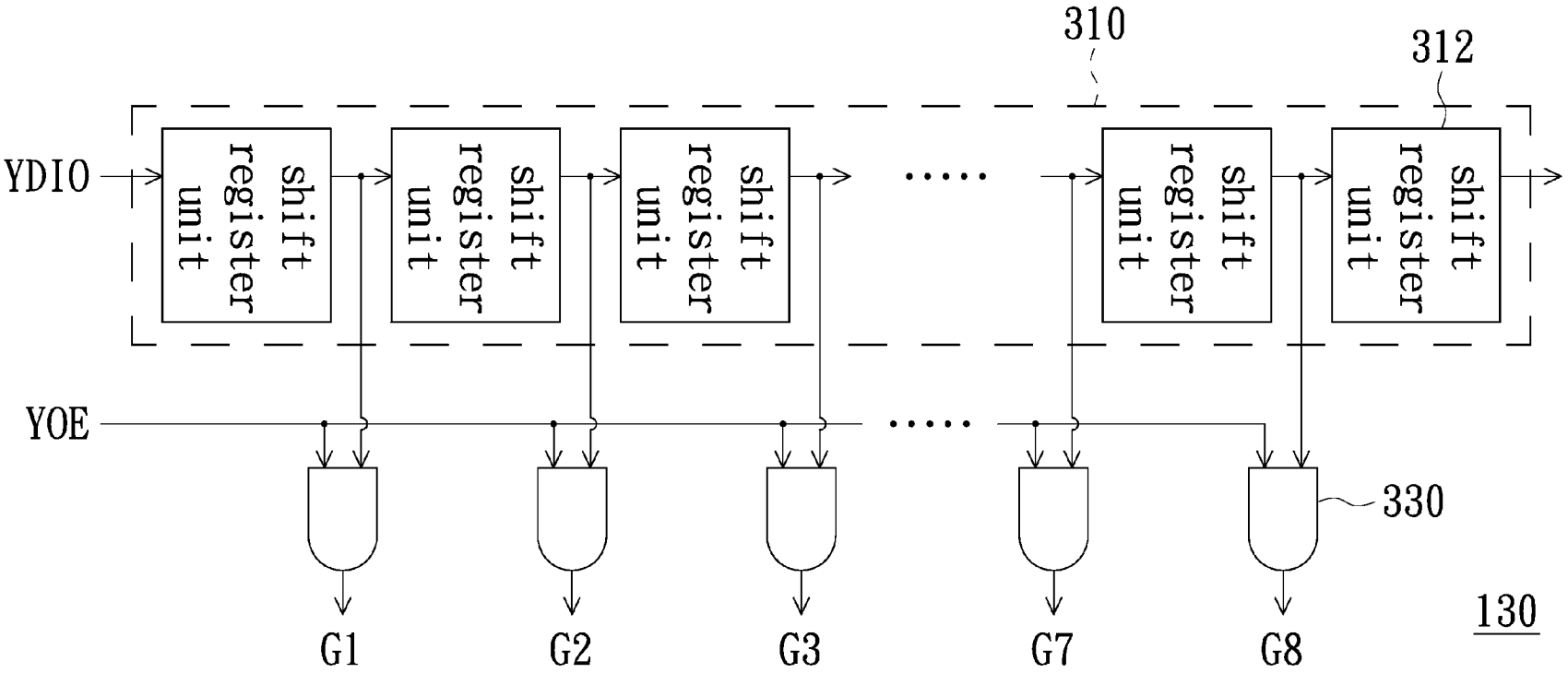
FIG. 3 is a schematic circuit view of the scan driving circuit.

FIG. 3 is a schematic circuit view of the scan driving circuit 130; wherein it is to be noted that the scan driving circuit 130 herein is exemplified by being configured to drive eight scan lines 114. As shown, the scan driving circuit 130 includes a shift register 310 and a plurality of (for example, eight) AND gates 330. The shift register 310 includes a plurality of (for example, eight) stages of shift register unit 312. Specifically, the first-stage shift register unit 312 is configured to receive an initial scan signal YDIO from the timing controller 140 at start of each frame period and accordingly these shift register units 312 are configured to sequentially output a scan pulse from an output terminal thereof. The AND gate 330 has a first input terminal, a second input terminal and an output terminal. The AND gates 330 each are configured to have its first input terminal electrically connected to the output terminal of its associated shift register unit 312; its second input terminal for receiving the output control signal YOE from the timing controller 140; and its output terminal electrically connected to its associated scan line 114. In other words, the eight AND gates 330 are configured to output the eight scan signals G1~G8 to the eight scan lines, respectively.

Please refer to FIGS. 1, 2A, 2B and 3 all. As shown, the output control signal YOE has a plurality of pulses in one frame period, and each pulse is used to control the scan driving circuit 130 to output a scan pulse so as to drive one of the eight scan lines 114. The output control signal XSTB also has a plurality of pulses in one frame period, and each pulse is used to control the data driving circuit 120 to process the display data, required by the pixels 116 electrically connected to at least one corresponding scan line 114, and then further control the data driving circuit 120 to output the processed display data to the corresponding data line(s) 112.

As illustrated in FIGS. 2A, 2B, it is to be noted that the output control signal XSTB has two types of pulses with different pulse widths. Specifically, the narrow-width pulse of the output control signal XSTB is used to control the data driving circuit 120 to process the display data required by the pixels 116 electrically connected to one associated scan line 114. For example, the narrow-width pulse occurring right before the time period 1 in FIG. 2A is used to control the data driving circuit 120 to process the display data required by the pixels 116 electrically connected to the first-row scan line 114. Alternatively, the wide-width pulse of the output control signal XSTB is used to control the data driving circuit 120 to process the display data required by the pixels 116 electrically connected to two associated scan lines 114. For example, the wide-width pulse occurring in the time period 4 in FIG. 2A is used to control the data driving circuit 120 to process the display data required by the pixels 116 electrically connected to the third-row and the fourth-row scan lines 114.

In this embodiment, the timing controller 140 can further divide each scan line group into a plurality of sub scan line groups each consisted of at least one scan line 114; wherein these sub scan line groups belonging to different scan line groups can be arranged intersecting to each other. For example, as illustrated in FIG. 2A, the timing controller 140 can further divide the first scan line group into two sub scan line groups; wherein the first-row and the second-row scan lines 114 are defined to the first sub scan line group of the first scan line group and the fifth-row and the sixth-row scan lines 114 are defined to the second sub scan line group of the first scan line group. Based on the same manner, as illustrated in FIG. 2B, the timing controller 140 can further divide the second scan line group into two sub scan line groups; wherein the third-row and the fourth-row scan lines 114 are defined to the first sub scan line group of the second scan line group and the seventh-row and the eighth-row scan lines 114 are defined to the second sub scan line group of the second scan line group.

Moreover, after driving a sub scan line group in one scan line group, in a same frame period the timing controller 140 is configured, through the scan driving circuit 130, to suspend a driving of at least one sub scan line group in another scan line group. For example, in the $K_{th}$ frame period as illustrated in FIG. 2A, the timing controller 140 suspends a driving of the first sub scan line group in the second scan line group (for example, the third-row and the fourth-row scan lines 114) after driving the first sub scan line group in the first scan line group (for example, the first-row and the second-row scan lines 114); afterwards, the timing controller 140 suspends a driving of the second sub scan line group in the second scan line group (for example, the seventh-row and the eighth-row scan lines 114) after driving the second sub scan line group in the first scan line group (for example, the fifth-row and the sixth-row scan lines 114).

In this embodiment, the timing controller 140 is further configured to control the data driving circuit 120 to postpone the processing time of the display data corresponding to the suspended sub scan line group, and then control the data driving circuit 120, before starting to process the next sub scan line group, to process the postponed display data in one time so as to release the postponed and processed display data. For example, as illustrated in FIG. 2A, the timing controller 140 firstly controls the data driving circuit 120 to postpone the processing time of the display data corresponding to the suspended first sub scan line group in the second scan line group (for example, the third-row and the fourth-row scan lines 114), and then controls the data driving circuit 120, before starting to process the second sub scan line group in the first scan line group (for example, the fifth-row and the sixth-row scan lines 114), to process the postponed display data in one time through the wide-width pulse of the output control signal XSTB (for example, the one in the time period 4) so as to release the postponed and processed display data. Afterwards, based on the same manner, the timing controller 140 firstly controls the data driving circuit 120 to postpone the processing time of the display data corresponding to the suspended second sub scan line group in the second scan line group (for example, the seventh-row and the eighth-row scan lines 114), and then controls the data driving circuit 120, before starting to process the next sub scan line group of scan line 114, to process the postponed display data in one time through the wide-width pulse of the output control signal XSTB (for example, the one in the time period 8) so as to release the postponed and processed display data. It is to be noted that, as illustrated in FIGS. 2A, 2B, the output control signal XSTB has one pulse only within the time periods of the display data corresponding to the suspended sub scan line group of scan line 114 is being processed.

In this embodiment, if the display data being provided from the timing controller 140 is for the pixels 116 required to be updated in this current frame period, the timing controller 140, through the output control signal XSTB, firstly controls the data driving circuit 120 to latch the display data and then controls the data driving circuit 120 to, after the display data is processed by the data driving circuit 120, supply the processed display data to the corresponding pixels 116 through the corresponding data lines 112. Specifically, the data driving circuit 120 is configured to latch the display data being provided from the timing controller 140 in response to a rising edge of each pulse of the output control signal XSTB, process the display data between a rising and falling edges of each pulse of the output control signal XSTB and output the processed display data to the corresponding data lines 112 in response to a falling edge of each pulse of the output control signal XSTB. Alternatively, if the display data being provided from the timing controller 140 is not for the pixels 116 required to be updated in this current frame period, the output control signal XSTB is maintained at a logic-low state so as to disable the latching operation of the data driving circuit 120.

Figure 4:
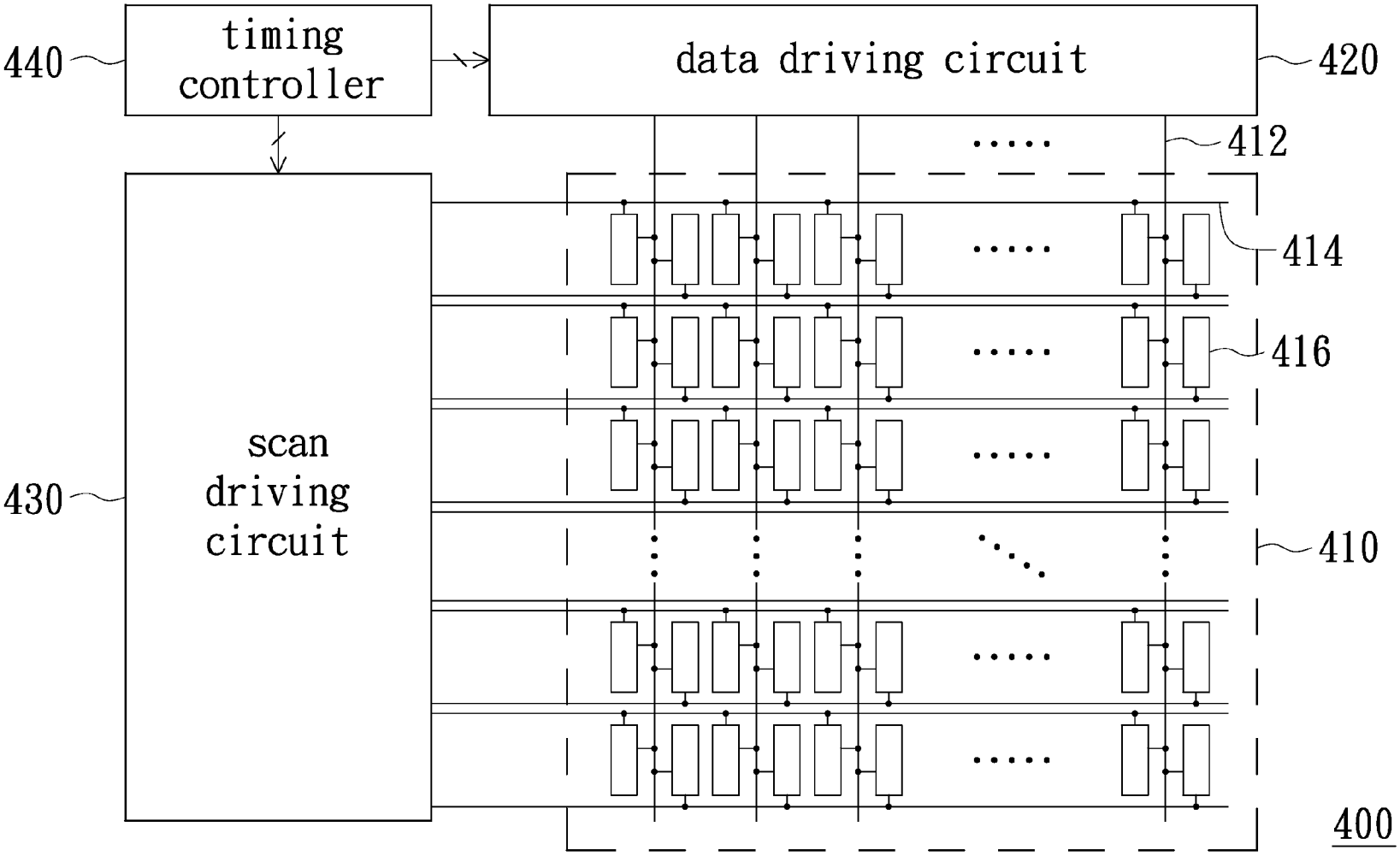
FIG. 4 is a schematic view of a display apparatus in accordance with another embodiment of the present disclosure.

FIG. 4 is a schematic view of a display apparatus in accordance with another embodiment of the present disclosure. As shown, the display apparatus 400 in this embodiment includes a display panel 410, a data driving circuit 420, a scan driving circuit 430 and a timing controller 440. The display panel 410 includes a plurality of data lines 412, scan lines 414 and pixels 416. Specifically, the pixels 416 are arranged in a matrix manner, and each is electrically connected to one data line 412 and one scan line 414. In addition, the pixels 416 electrically connected to a same one scan line 414 and the pixels 416 electrically connected to another same one scan line 414 are intersecting to each other (for example, intersecting to each other in an extending direction of the scan line 414), and a pair of these aforementioned intersecting pixels 416 belonging to different scan lines 414 are electrically connected to same one data line 412. The data driving circuit 420 is electrically connected to the data lines 412, and the scan driving circuit 430 is electrically connected to the scan lines 414. The timing controller 440 is electrically connected to the scan driving circuit 430 and configured to control the scan driving circuit 430 to drive the scan lines 414. In addition, the timing controller 440 is further electrically connected to the data driving circuit 420 and configured to sequentially supply display data to the data driving circuit 420 and control the data driving circuit 420 to sequentially provide the display data to the pixels 416.

In this embodiment, the timing controller 440 is further configured to divide these scan lines 414 into N scan line groups and sequentially drive, through the scan driving circuit 430, the N scan line groups of scan line 414 in N frame periods, respectively; wherein N is an integer from 2 to the number of the scan lines 414. To get a better understanding of the present disclosure, the display panel 410 in this embodiment is exemplified by including sixteen scan lines 414 and the operation of the display apparatus 400 will be described in detail with the reference of FIGS. 5A, 5B.

Figure 5A:
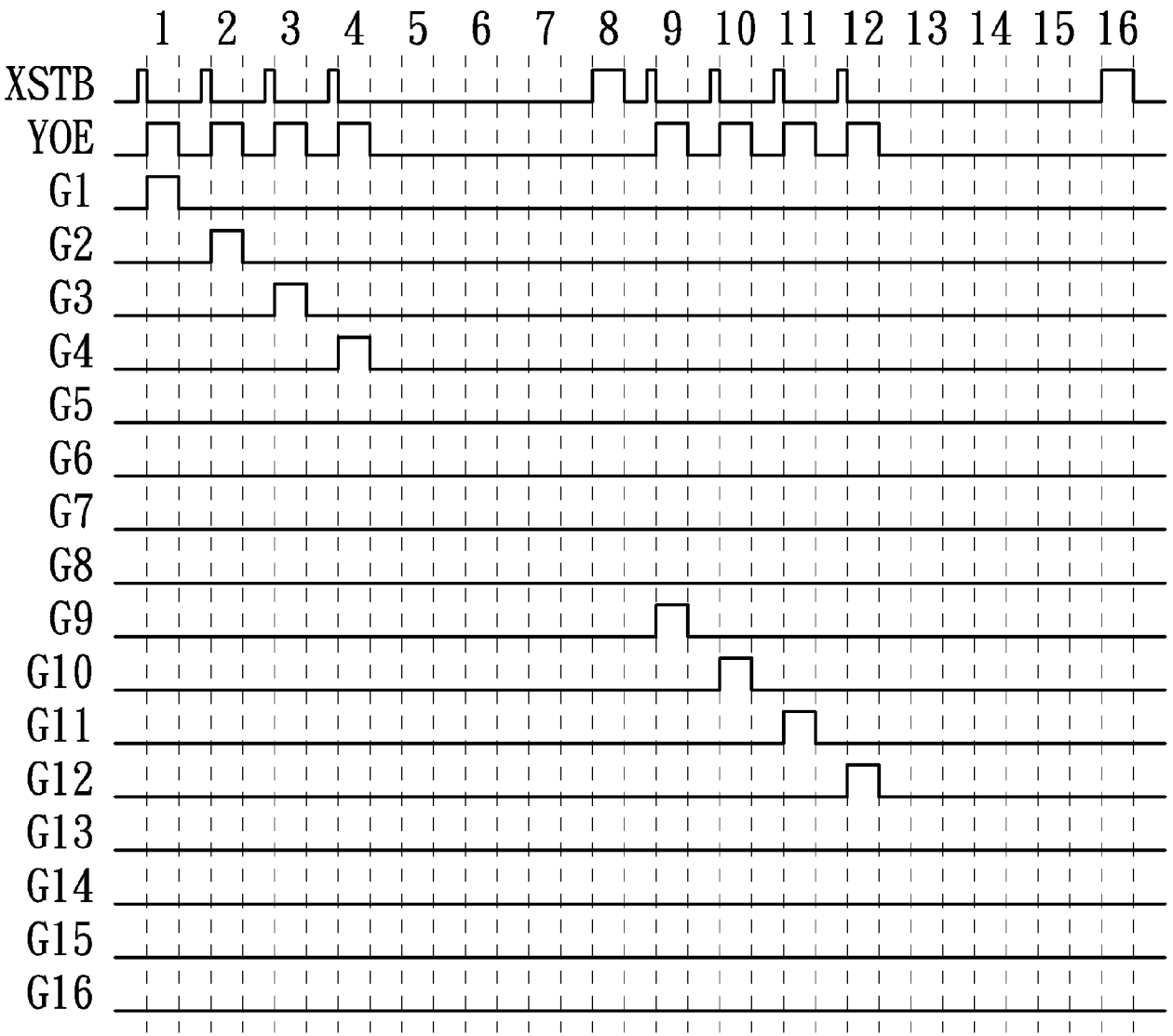
FIG. 5A is a schematic time sequence view of sixteen scan signals of the respective sixteen scan lines and other signals associated with the display apparatus in FIG. 4 in the $K_{th}$ frame period.
Figure 5B:
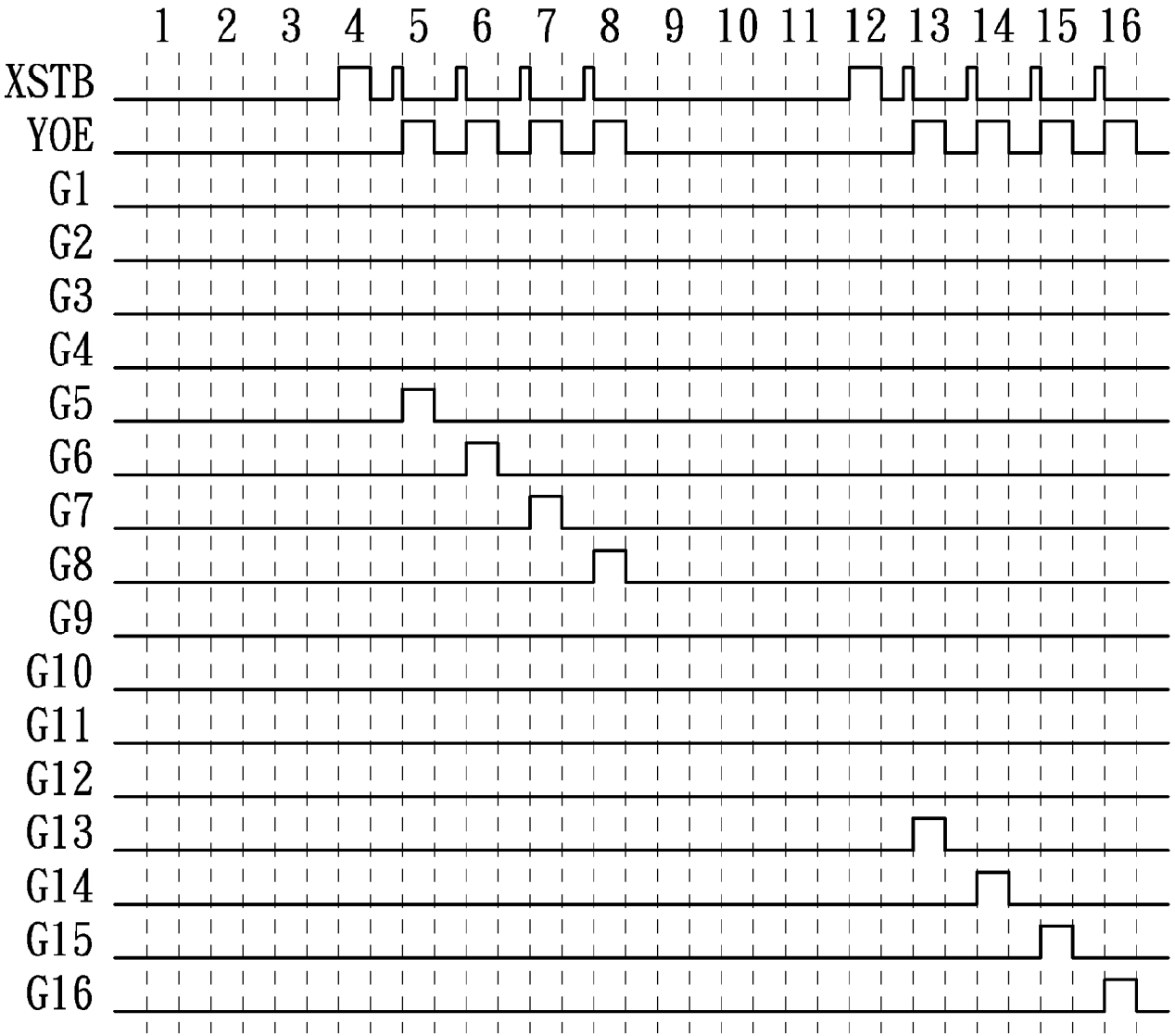
FIG. 5B is a schematic time sequence view of eight scan signals of the respective eight scan lines and other signals associated with the display apparatus in FIG. 4 in the $(K+1)_{th}$ frame period.

FIGS. 5A, 5B are schematic time sequence views of sixteen scan signals of the respective sixteen scan lines 414 and other signals associated with the display apparatus 400 in the $K_{th}$ and $(K+1)_{th}$ frame periods, respectively. Moreover, the schematic time sequences illustrates in FIGS. 5A, 5B can also be applied on display apparatus as shown in FIG. 1. Specifically, the sixteen scan signals of the respective sixteen scan lines 414 (from the first-row to the sixteen-row scan lines 414) are designated by G1~G16, respectively. The signal XSTB, an output control signal and outputted from the timing controller 440 to the data driving circuit 420, is configured to control an operation of the data driving circuit 420. The signal YOE, an output control signal and outputted from the timing controller 440 to the scan driving circuit 430, is configured to control an operation of the scan driving circuit 430. The configurations of the output control signals XSTB, YOE for the operations of the respective data driving circuit 420 and the scan driving circuit 430 will be described in detail later.

In the $K_{th}$ frame period as illustrated in FIG. 5A, the scan signals G1, G2, G3, G4, G9, G10, G11 and G12 are exemplified by having one scan pulse at time periods 1, 2, 3, 4, 9, 10, 11 and 12, respectively; and the scan signals G5, G6, G7, G8, G13, G14, G15 and G16 each are exemplified by having no any scan pulse within the time periods 1~16. In the $(K+1)_{th}$ frame period as illustrated in FIG. 5B, the scan signals G5, G6, G7, G8, G13, G14, G15 and G16 are exemplified by having one scan pulse at time periods 5, 6, 7, 8, 13, 14, 15 and 16, respectively; and the scan signals G1, G2, G3, G4, G9, G10, G11 and G12 each are exemplified by having no any scan pulse within the time periods 1~16. Accordingly, the timing controller 440 can divide these sixteen scan lines 414 into two scan line groups; specifically, the first-row, the second-row, the third-row, the fourth-row, the ninth-row, the tenth-row, the eleventh-row and the twelfth-row scan lines 414 are defined to the first scan line group, and the fifth-row, the sixth-row, the seventh-row, the eighth-row, the thirteenth-row, the fourteenth-row, the fifteenth-row and the sixteenth-row scan lines 414 are defined to the second scan line group.

Through the aforementioned division, in the $K_{th}$ frame period the timing controller 440 can drive, through the scan driving circuit 430, the first scan line group only and then drive the second scan line group in the $(K+1)_{th}$ frame period. In other words, the timing controller 440 can sequentially drive two scan line groups of scan line 414 so as to sequentially update the display data of the corresponding pixels 416 in two frame periods, respectively.

Therefore, through driving a portion of these scan lines 414 only (specifically, the scan lines 414 having a scan pulse) in a frame period, the display apparatus 400 according to the present disclosure can have lower power consumption.

Please refer to FIGS. 4, 5A, and 5B all. As shown, the output control signal YOE has a plurality of pulses in one frame period, and each pulse is used to control the scan driving circuit 430 to output a scan pulse so as to drive one of the sixteen scan lines 414. The output control signal XSTB also has a plurality of pulses in one frame period, and each pulse is used to control the data driving circuit 420 to process the display data, required by the pixels 416 electrically connected to at least one corresponding scan line 414, and then further control the data driving circuit 420 to output the processed display data to the corresponding data line(s) 412.

As illustrated in FIGS. 5A, 5B, it is to be noted that the output control signal XSTB has two types of pulses with different pulse widths. Specifically, the narrow-width pulse of the output control signal XSTB is used to control the data driving circuit 420 to process the display data required by the pixels 416 electrically connected to one associated scan line 414. For example, the narrow-width pulse occurring right before the time period 1 in FIG. 5A is used to control the data driving circuit 420 to process the display data required by the pixels 416 electrically connected to the first-row scan line 414. Alternatively, the wide-width pulse of the output control signal XSTB is used to control the data driving circuit 420 to process the display data required by the pixels 416 electrically connected to four associated scan lines 414. For example, the wide-width pulse occurring in the time period 8 in FIG. 5A is used to control the data driving circuit 420 to process the display data required by the pixels 116 electrically connected to the fifth-row, the sixth-row, the seventh-row and the eighth-row scan lines 414.

In this embodiment, the timing controller 440 can further divide each scan line group into a plurality of sub scan line groups each consisted of at least one scan line 414; wherein these sub scan line groups belonging to different scan line groups can be arranged intersecting to each other. For example, as illustrated in FIG. 5A, the timing controller 440 can further divide the first scan line group into two sub scan line groups; wherein the first-row, the second-row, the third-row and the fourth-row scan lines 414 are defined to the first sub scan line group of the first scan line group and the ninth-row, the tenth-row, the eleventh-row and the twelfth-row scan lines 414 are defined to the second sub scan line group of the first scan line group. Based on the same manner, as illustrated in FIG. 5B, the timing controller 440 can further divide the second scan line group into two sub scan line groups; wherein the fifth-row, the sixth-row, the seventh-row and the eighth-row scan lines 414 are defined to the first sub scan line group of the second scan line group and the thirteenth-row, the fourteenth-row, the fifteenth-row and the sixteenth-row scan lines 414 are defined to the second sub scan line group of the second scan line group.

Moreover, after driving a sub scan line group in one scan line group, in a same frame period the timing controller 440 is configured, through the scan driving circuit 430, to suspend a driving of at least one sub scan line group in another scan line group. For example, in the $K_{th}$ frame period as illustrated in FIG. 5A, the timing controller 440 suspends a driving of the first sub scan line group in the second scan line group (for example, the fifth-row, the sixth-row, the seventh-row and the eighth-row scan lines 414) after driving the first sub scan line group in the first scan line group (for example, the first-row, the second-row, the third-row and the fourth-row scan lines 414); afterwards, the timing controller 440 suspends a driving of the second sub scan line group in the second scan line group (for example, the thirteenth-row, the fourteenth-row, the fifteenth-row and the sixteenth-row scan lines 414) after driving the second sub scan line group in the first scan line group (for example, the ninth-row, the tenth-row, the eleventh-row and the twelfth-row scan lines 414).

In this embodiment, the timing controller 440 is further configured to control the data driving circuit 420 to postpone the processing time of the display data corresponding to the suspended sub scan line group, and then control the data driving circuit 420, before starting to process the next sub scan line group, to process the postponed display data in one time so as to release the postponed and processed display data. For example, as illustrated in FIG. 5A, the timing controller 440 firstly controls the data driving circuit 420 to postpone the processing time of the display data corresponding to the suspended first sub scan line group in the second scan line group (for example, the fifth-row, the sixth-row, the seventh-row and the eighth-row scan lines 414), and then controls the data driving circuit 420, before starting to process the second sub scan line group in the first scan line group (for example, the ninth-row, the tenth-row, the eleventh-row and the twelfth-row scan lines 414), to process the postponed display data in one time through the wide-width pulse of the output control signal XSTB (for example, the one in the time period 8) so as to release the postponed and processed display data. Afterwards, based on the same manner, the timing controller 440 firstly controls the data driving circuit 420 to postpone the processing time of the display data corresponding to the suspended second sub scan line group in the second scan line group (for example, the thirteenth-row, the fourteenth-row, the fifteenth-row and the sixteenth-row scan lines 414), and then controls the data driving circuit 420, before starting to process the next sub scan line group of scan line 414, to process the postponed display data in one time through the wide-width pulse of the output control signal XSTB (for example, the one in the time period 16) so as to release the postponed and processed display data. It is to be noted that, as illustrated in FIGS. 5A, 5B, the output control signal XSTB has one pulse only within the time periods of the display data corresponding to the suspended sub scan line group of scan line 414 is being processed.

Figure 6:
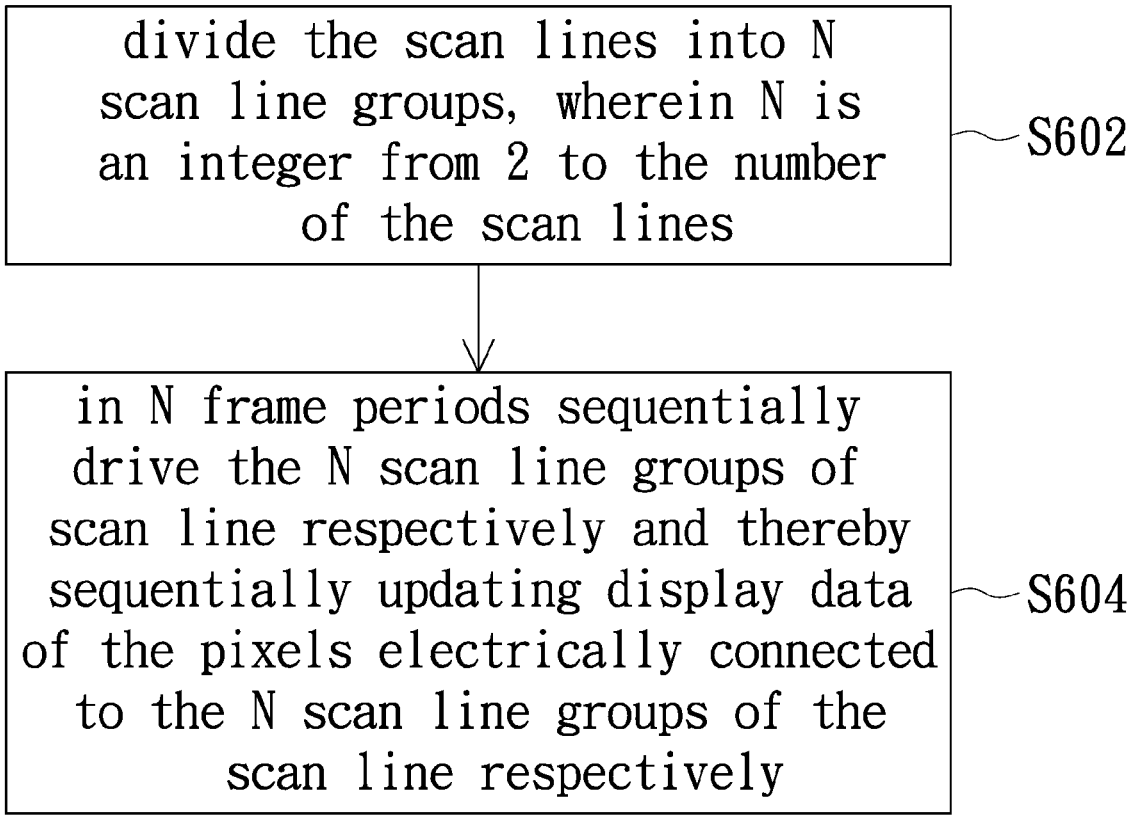
FIG. 6 is a schematic flow chart of an operation method of a display apparatus in accordance with an embodiment of the present disclosure.

According to the descriptions, the display apparatus according to the present disclosure can be summarized to have some basic operation steps as illustrated in FIG. 6, which is a schematic flow chart of an operation method of a display apparatus in accordance with an embodiment of the present disclosure. Specifically, the display panel includes a plurality of data lines, a plurality of scan lines and a plurality of pixels; the pixels are arranged in a matrix manner, and each pixel is electrically connected to one of the data lines and one of the scan lines. As shown, the operation method includes steps of: dividing the scan lines into N scan line groups, wherein N is an integer from 2 to the number of the scan lines (step S602); and in N frame periods sequentially driving the N scan line groups of scan line respectively and thereby sequentially updating display data of the pixels electrically connected to the N scan line groups of the scan line respectively (step S604), To sum up, through dividing the scan lines of a display panel into N scan line groups (N is an integer from 2 to the number of the scan lines) and in N frame periods sequentially driving the N scan line groups of scan line respectively and thereby sequentially updating display data of the pixels electrically connected to the N scan line groups of the scan line respectively, the display apparatus according to the present disclosure can have lower power consumption due to only a portion of scan lines are driven in one frame period.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A partially-driven display apparatus, comprising:

a display panel, comprising:

a plurality of data lines;

a plurality of scan lines; and a plurality of pixels arranged in a matrix manner, and each pixel being electrically connected to one of the data lines and one of the scan lines;

a data driving circuit electrically connected to the data lines;

a scan driving circuit electrically connected to the scan lines; and a timing controller electrically connected to the scan driving circuit and the data driving circuit configured to divide the plurality of scan lines into N scan line groups, sequentially drive, through the scan driving circuit, the N scan line groups in N frame periods respectively and thereby sequentially updating display data of the pixels electrically connected to the N scan line groups of the scan line in the N frame periods respectively, and wherein each of the N scan line groups includes at least two of the plurality of scan lines, wherein the timing controller is further configured to divide each scan line group into a plurality of sub scan line groups, each sub scan line group includes at least one scan line, the sub scan line groups of the scan line groups are arranged intersecting to each other, wherein in one frame period the timing controller is further configured to, after driving one of the sub scan line groups in one scan line group through the scan driving circuit, suspend a driving of at least one sub scan line group in another scan line group, and wherein the timing controller is further configured to firstly control the data driving circuit to postpone a processing time of the display data corresponding to the suspended sub scan line group, and control the data driving circuit, before starting to process a next sub scan line group, to process the postponed display data in one time so as to release the postponed and processed display data.

2. The partially-driven display apparatus according to claim 1, wherein the timing controller is further configured to sequentially provide the display data of the pixels electrically connected to the scan driving circuit, wherein in each frame period the timing controller is configured to, if the display data being provided from the timing controller is for the pixels required to be updated, firstly control the data driving circuit to latch the display data and then supply the display data after being processed by the data driving circuit to the corresponding pixels through the corresponding data lines, and wherein in each frame period the timing controller is configured to, if the display data being provided from the timing controller is not for the pixels required to be updated, disable the latching operation of the data driving circuit.

3. The partially-driven display apparatus according to claim 1, wherein N is equal to or greater than 3, and the scan line(s) in one group and the scan line(s) in another group are arranged to intersect to each other along a direction vertical to the data lines.

4. A partially-driven display apparatus, comprising:

a display panel, comprising:

a plurality of data lines;

a plurality of scan lines; and a plurality of pixels arranged in a matrix manner, and each pixel being electrically connected to one of the data lines and one of the scan lines;

a data driving circuit electrically connected to the data lines and configured to provide display data to the pixels through the data lines;

a scan driving circuit electrically connected to the scan lines, comprising:

a shift register comprising a plurality of stages of shift register unit and configured to control the shift register units to sequentially provide a scan pulse through an output terminal thereof; and a plurality AND gates each having a first input terminal, a second input terminal and an output terminal, wherein each AND gate is configured to have the first input terminal electrically connected to the output terminal of one of the shift register units, the second input terminal for receiving a first output control signal and the output terminal electrically connected to one of the scan lines; and a timing controller electrically connected to the data driving circuit and the scan driving circuit and configured to control the data driving circuit to provide the display data of the pixels and output the first output control signal to the scan driving circuit thereby controlling an operation of the scan driving circuit through the first output control signal, wherein the first output control signal has a plurality of pulses, each pulse is used to control the scan driving circuit to output a scan pulse for driving one of the scan lines, wherein the timing controller is further configured to divide the plurality of scan lines into N scan line groups, sequentially drive, through the scan driving circuit, the N scan line groups in N frame periods respectively and thereby sequentially updating display data of the pixels electrically connected to the corresponding scan line of the plurality of scan lines in N frame periods respectively, and wherein each of the N scan line groups includes at least two of the plurality of scan lines, wherein the timing controller is further configured to output a second output control signal to the data driving circuit thereby controlling an operation of the data driving circuit through the second output control signal, the second output control signal has a plurality of pulses, each pulse is used to firstly control the data driving circuit to process the display data required by the pixels electrically connected to at least one scan line and then control the data driving circuit to output the processed display data to the data lines, wherein the timing controller is further configured to divide each scan line group into a plurality of sub scan line groups, each sub scan line group includes at least one scan line, the sub scan line groups of the scan line groups are arranged intersecting to each other, wherein in one frame period the timing controller is further configured to, after driving one of the sub scan line groups in one scan line group through the scan driving circuit, suspend a driving of at least one sub scan line group in another scan line group, wherein the timing controller is further configured to firstly control the data driving circuit to postpone a processing time of the display data corresponding to the suspended sub scan line group, and control the data driving circuit, before starting to process a next sub scan line group, to process the postponed display data in one time so as to release the postponed and processed display data, and wherein the second output control signal has one pulse only within the time periods of the display data corresponding to the suspended sub scan line group of scan line is being processed.

5. The partially-driven display apparatus according to claim 4, wherein the timing controller is further configured to output a second output control signal to the data driving circuit thereby controlling an operation of the data driving circuit through the second output control signal, wherein the timing controller is further configured to sequentially provide the display data of the pixels electrically connected to the scan driving circuit, the second output control signal has a plurality of pulses, each pulse is used to firstly control the data driving circuit to process the display data required by the pixels electrically connected to at least one scan line and then control the data driving circuit to output the processed display data to the data lines, wherein in each frame period the timing controller is configured to, if the display data being provided from the timing controller is for the pixels required to be updated, firstly control the data driving circuit to latch the display data and then supply the display data after being processed by the data driving circuit to the corresponding pixels through the corresponding data lines, and wherein in each frame period the timing controller is configured to, if the display data being provided from the timing controller is not for the pixels required to be updated, disable the latching operation of the data driving circuit.

6. The partially-driven display apparatus according to claim 4, wherein the timing controller is further configured to output a second output control signal to the data driving circuit thereby controlling an operation of the data driving circuit through the second output control signal, wherein the timing controller is further configured to sequentially provide the display data of the pixels electrically connected to the scan driving circuit, the second output control signal has a plurality of pulses, each pulse is used to firstly control the data driving circuit to process the display data required by the pixels electrically connected to at least one scan line and then control the data driving circuit to output the processed display data to the data lines, wherein in each frame period the timing controller is configured to, if the display data being provided from the timing controller is for the pixels required to be updated, firstly control the data driving circuit to latch the display data and then supply the display data after being processed by the data driving circuit to the corresponding pixels through the corresponding data lines, and wherein in each frame period the timing controller is configured to, if the display data being provided from the timing controller is not for the pixels required to be updated, disable the latching operation of the data driving circuit.

7. The partially-driven display apparatus according to claim 4, wherein the data driving circuit is configured to latch the display data being provided from the timing controller in response to a rising edge of each pulse of the second output control signal, process the display data between a rising and falling edges of each pulse of the second output control signal and output the processed display data to the corresponding data lines in response to a falling edge of each pulse of the second output control signal.

8. The partially-driven display apparatus according to claim 4, wherein N is equal to or greater than 3, and the scan line(s) in one group and the scan line(s) in another group are arranged to intersect to each other along a direction vertical to the data lines.

9. An operation method of a partially-driven display apparatus, the display apparatus comprising a display panel, the display panel comprising a plurality of data lines, a plurality of scan lines and a plurality of pixels, the pixels being arranged in a matrix manner, and each pixel being electrically connected to one of the data lines and one of the scan lines, the operation method comprising:

dividing the plurality of scan lines into N scan line groups, wherein each of the N scan line groups includes at least two of the plurality of scan lines; and in N frame periods sequentially driving the N scan line groups respectively and thereby sequentially updating display data of the pixels electrically connected to the corresponding scan line of the plurality of scan lines respectively, wherein the operation method further comprising:

dividing each scan line group into a plurality of sub scan line groups, wherein each sub scan line group includes at least one scan line, and the sub scan line groups of the scan line groups are arranged intersecting to each other;

in one frame period suspending, once one sub scan line group in one scan line group is being driven, a driving of at least one sub scan group in another scan line group; and postponing a processing time of the display data corresponding to the suspended sub scan line group, and processing, before starting to process a next sub scan line group, the postponed display data in one time and thereby releasing the postponed and processed display data.

10. The operation method according to claim 9, N being equal to or greater than 3, the operation method further comprising:

arranging the scan line(s) in one group and the scan line(s) in another group to intersect to each other along a direction vertical to the data lines.

* * * * *